United States Patent [19]

Monsees et al.

[11] 4,423,585

[45] Jan. 3, 1984

[54] PACKAGE FORMING APPARATUS AND METHOD

[75] Inventors: Claude E. Monsees; William W. Simpson, both of Durham, N.C.

[73] Assignee: Rexham Corporation, Charlotte, N.C.

[21] Appl. No.: 294,551

[22] Filed: Aug. 20, 1981

[51] Int. Cl.[3] ..... B65B 9/14; B65B 41/12

[52] U.S. Cl. ..... 53/451; 53/551; 53/389

[58] Field of Search ..... 53/551, 552, 389, 550, 53/546, 451

[56] References Cited

U.S. PATENT DOCUMENTS

| | | | |
|---|---|---|---|
| 2,953,882 | 9/1960 | Tew | 53/552 X |
| 2,982,334 | 5/1961 | Cooper et al. | 53/551 X |
| 3,027,695 | 4/1962 | Leasure | 53/552 X |
| 4,023,327 | 5/1977 | Simmons | 53/552 X |
| 4,171,605 | 10/1979 | Putnam, Jr. et al. | 53/552 |

FOREIGN PATENT DOCUMENTS

| | | | |
|---|---|---|---|
| 459384 | 5/1975 | U.S.S.R. | 53/551 |

*Primary Examiner*—Horace M. Culver
*Attorney, Agent, or Firm*—B. B. Olive

[57] ABSTRACT

A package forming and filling machine of the type which forms sheet material into a tube and the tube into individual packages incorporates a pair of magnetizable bars which are suspended within the tube during filling and are magnetically attracted outwardly during filling so as to maintain the tube open for the fill material. Associated driven belts engage external tube surfaces and are timed to operate in coordination with the tube sealing, stripping and severing mechanism.

15 Claims, 9 Drawing Figures

PACKAGE FORMING APPARATUS AND METHOD

DESCRIPTION

TECHNICAL FIELD

The invention relates to an improved apparatus and method for a package forming and filling machine of the type in which a continuous web of sheet material is guided through a tube former to form a tube which is filled, sealed and discharged as separately filled packages, e.g., bags of potato chips.

BACKGROUND ART

The apparatus and method of the invention are intended to be used with a bag forming and filling machine of the type which forms, fills, and seals packages made up from a flexible packaging material drawn through a tube former. U.S. Pat. No. 2,953,882 illustrates such a machine and such patent may be referred to for useful background information related to this type of package forming and filling machine.

One of the problems which has long been recognized and encountered in connection with using the type of package forming and filling machine mentioned above has been that of keeping the tube open during the filling operation. For example, when packaging potato chips it is necessary to fill each package with the required weight of potato chips and also to accomplish the filling operation within minimum time to expedite the stripping and sealing operations which typically follow filling of the package and severing of the filled package from the tubular formed packaging material in the machine. Additional useful background related to the stripping, sealing and severing operations can be found in U.S. Pat. No. 3,027,695.

With more specific reference to the problem dealt with by the present invention, it has been known to use vacuum belts to pull the tube material outwardly during filling. Also, the fill material is sometimes introduced through a rigid tube which keeps the bag open during the fill operation. However, none of the prior art apparatus or methods for keeping the bag open during filling have proven satisfactory, particularly when dealing with fill materials with the character of potato chips which need a flexible bag.

Another aspect of prior art practice related to the present invention has been the employment of a sealing apparatus which effects a heat seal under pressure obtained by holding a magnetizable bar suspended within the tube pressed against a magnetic source located outside the tube. This type of longitudinal seam sealer using the described magnetic bar arrangement is described in U.S. Pat. No. 2,982,334, the teachings of which are deemed to be incorporated herein by reference. U.S. Pat. No. 2,982,334 thus represents a type of magnetic clamp which can be turned on and off. In addition to this type of magnetic clamp wherein a magnetizable bar and a magnetic source are used in stationary positions, recognition is also given to other prior art practices in which endless belts incorporating magnets as well as platens incorporating magnets have been used in various ways for applying pressure to a selected material or for moving such material in a selected direction.

Taking all of the foregoing prior art into account, there has not been provided, so far as applicants are aware, an apparatus and method based on using plural sets of magnetizable bars suspended within the tube in conjunction with magnet sources mounted outside the tube as a means for maintaining the tube open during filling. Further, such method and apparatus of using magnetic forces to keep the tube open during filling have not been previously employed in conjunction with associated belt drives to assist in moving the tube material away from the machine.

DISCLOSURE OF INVENTION

The apparatus and method of the invention as previously mentioned are intended to be used with a package forming and filling machine of the type in which a continuous web of sheet material is drawn through a tube former into a generally cylindrical tube with the longitudinal edges of the overlapping material being sealed along one side of the tube and with the tube being used to form individual packages which are filled and sealed at the top and bottom. In this type of machine, the material is periodically drawn through the tube former at intervals between which the tube is stationary. The apparatus employed to form the top and bottom seals is conventionally associated with means for stripping each package before forming the top seal of the package being discharged simultaneously with forming the bottom seal of the package next to be filled.

In combination with the foregoing type of conventional apparatus and method of operation, the present invention provides a pair of relatively light magnetizable bars which are mounted to extend into the tube forming apparatus so as to reside inside the tube in spaced apart positions. Only the outer end of each bar is mounted and the inner end of each bar is left unsecured. On the outside of the tube adjacent each magnetizable bar there is provided a magnet assembly having an associated belt drive. In operation, as each individual package is presented for the filling operation, magnetic forces asserted by the magnet assemblies on the outside of the tube cause the bars to be drawn outwardly and thereby effectively open up the tube to a maximum extent so as to provide an uninterrupted path for the fill material during the fill operation. At an appropriate time in the operating sequence, the belt drive on each magnet assembly is energized so as to draw the tube material through the machine in coordination with and in operative association with a conventional apparatus employed to strip the package being filled and thereafter simultaneously form the top seal of the package being discharged, the bottom seal of the next succeeding package to be filled and to separate the package being discharged from the tube material.

BEST MODE FOR CARRYING OUT THE INVENTION

Reference has already been made to prior art U.S. Pat. No. 2,953,882 showing a package forming, filling and sealing machine of the general type to which the present invention relates, U.S. Pat. No. 2,982,334 showing a longitudinal seam sealer using a magnetized bar and U.S. Pat. No. 3,027,695 showing a method and apparatus for stripping and forming the top and bottom seals in the type of package forming, filling and sealing machine to which the invention relates. Therefore, with such prior art apparatus and methods in mind, only so much of the prior art apparatus and methods will be described herein as is necessary to show the environment for the magnetic package opening and drive belt apparatus and method associated with the present invention.

Figure 1:
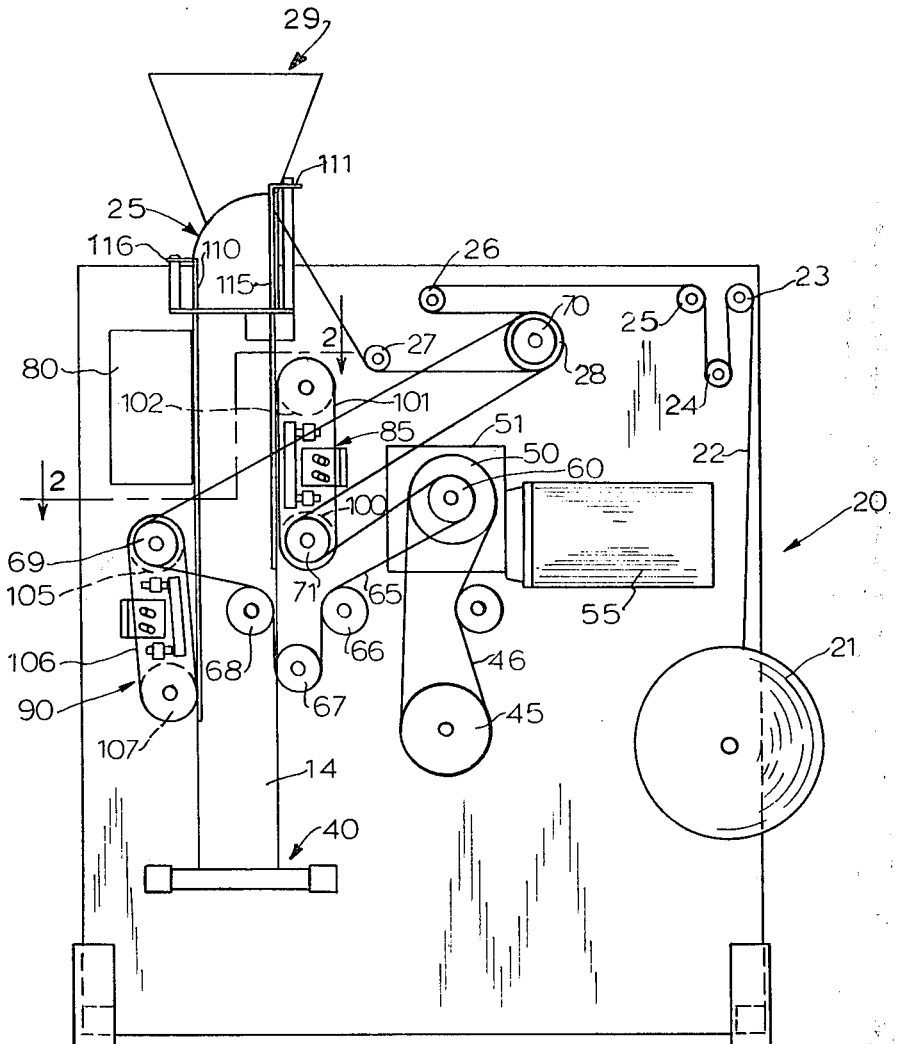
FIG. 1 is a somewhat schematic front view of a package forming and filling machine according to the invention.

FIG. 1 illustrates the improved machine 20 of the invention and shows a roll 21 of web material 22, e.g., heat sealable, plastic, sheet material, fed over various guide rollers 23–27 and pulled by a driven roller 28. The web 22 is fed to a suitable tube former 25 below a feed hopper 29 and is guided by inner surfaces of tube former 25 so as to assume a tubular shape with its longitudinal edges overlapped at the left side of the tube, indicated in phantom lines 14, as seen in FIG. 1.

A combined stripping, drawbar and transverse sealing mechanism 40 periodically grips the tube 14 to effect a stripping action followed by drawing the tube 14 downwardly to draw additional tube material through former 25 and to effect a transverse seal across the tube 14 followed by severing of the formed and filled package through the transverse seal area. Such method of operation, as it specifically relates to the present apparatus and method, will be dealt with in more detail in later description in reference to FIGS. 8 and 9.

The stripping, drawbar and transverse sealing mechanism 40 operate through an appropriate drive mechanism, not shown, connected to driven pulley 45 driven by chain 46. Chain 46 in turn is driven by a driven pulley 50 powered through a transmission 51 by a drive motor 55. Drive motor 55 provides a single machine power source for all machine operations and may be timed by a cam, photodetector operating off printed matter on the web material or by other conventional timing means known in the art so as to coordinate the various web feeding, draw down, stripping and sealing operations in timed sequence as will be better understood through later description.

As further illustrated in FIG. 1, a drive pulley 60 rotates with drive pulley 50 and drives chain 65 entrained on pulleys 66–71. The previously-mentioned web-feeding roller 28 is thus intermittently driven through chain 65 rotating pulley 70.

A longitudinal sealer 80 forms the longitudinal seal on tube 14 and while preferably of the type described in the previously-mentioned U.S. Pat. No. 2,982,334 may be of any type known in the art and suited to forming the longitudinal seal. Sealer 80 is shown on the "back" side of the tube 14.

Referring next and more specifically to the principal invention apparatus and method, there is located opposite and extending below longitudinal sealer 80 as seen in FIG. 1, a tube opening and belt drive device 85 constituting a principal feature of the invention and later described in detail. With continuing reference to FIG. 1, there is located on the same side of tube 14 as sealer 80 is located and below the position of sealer 80, a second tube opening and belt drive device 90 employing a construction similar to that of the first tube opening and belt drive device 85. Devices 85 and 90 serve the function of maintaining the tube 14 open below the former 25 so as to provide an unobstructed path for the gravity fed fill material falling into tube 14 and being packaged. A second function served by devices 85 and 90 is that of providing means for pulling the tube 14 through the former 25 intermittently and in coordination with operation of the stripping, drawbar, and transverse sealing mechanism 40. Also, tube flexibility is maintained.

Device 85 includes a driven pulley 100 which rotates with driven pulley 71 and provides a means for driving belt 101 entrained on pulley 102. Utilizing a similar arrangement, pulley 105 rotates with pulley 69 to drive belt 106 entrained on pulley 107 on drive 90.

Since the construction used in device 85 is similar to the construction used in device 90, device 90 in reference to FIGS. 3–7 will be used as a basis for describing such construction from which the general operation of the invention apparatus and method will be fully understood.

Figure 2:
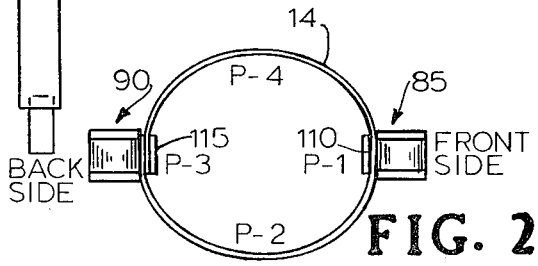
FIG. 2 is a partial cross section view taken generally in the direction of line 2—2 of FIG. 1.
Figure 3:
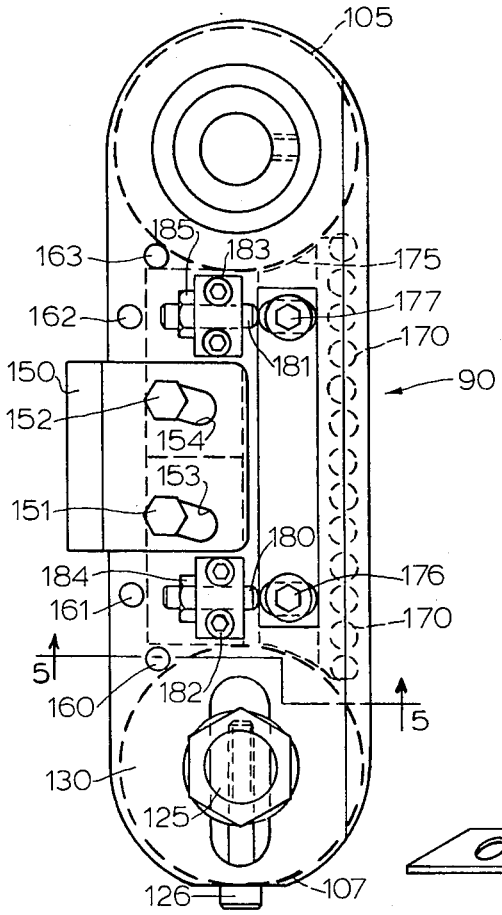
FIG. 3 is a side view of one belt drive-magnetic assembly of the invention.
Figure 4:
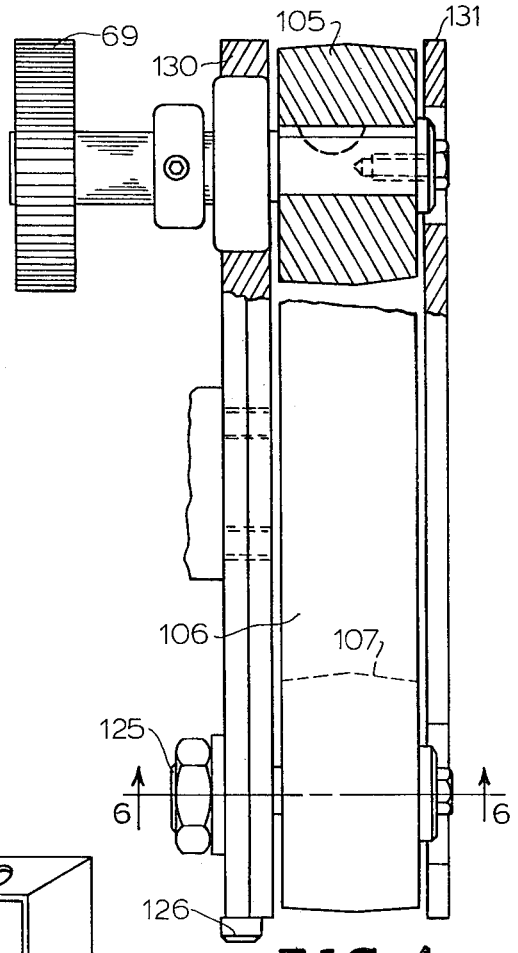
FIG. 4 is an end view of the belt drive-magnetic assembly of FIG. 3 with parts being broken away to facilitate illustration of a drive pulley.

Device 85 has associated therewith a magnetizable bar 110 having one end secured to a bracket 111. The opposite end of bar 110 is unsecured and bar 110 is mounted so as to extend through former 25 and to reside within tube 14 adjacent device 85. Bar 110 terminates at a point below the lower end of device 85. In a similar manner, magnetizable bar 115 has one end secured to a bracket 116 with the opposite end being unsecured. Bar 115 also extends through former 25 and resides within tube 14 opposite bar 110 and adjacent device 90. Bar 115 terminates below the lower end of device 90. Devices 85 and 90 provide respective means, later described in more detail, for magnetically attracting the respective magnetizable bars 110 and 115 outwardly so as to hold the tube 14 open during the filling operation as best illustrated in FIG. 2. Also to be noted is that when sealer 80 is of the magnetic bar type described in U.S. Pat. No. 2,982,334, sealer 80 will also provide means for magnetically attracting bar 115 in the manner fully described in U.S. Pat. No. 2,982,334. Thus, tube 14 on the left side as viewed in FIG. 1 will be opened by the combined magnetic opening effects of sealer 80 and device 90.

Referring more specifically to FIGS. 3–6 and using device 90 as an example of the construction employed in devices 85, 90, belt 106 mounts on pulleys 105 and 107. Idler pulley 107 mounts on shaft 125 and is adjusted by means of adjusting screw 126 to loosen or tighten belt 106. A pair of opposed plates 130, 131 are formed of steel or other magnetizable material and support therebetween four rectangular magnets 140–143 having respective polar faces suitably oriented to establish a magnetic field 120 through and for the purpose of attracting bar 115 towards device 90.

A slotted bracket 150 is suitably attached to the machine frame and by means of bolts 151, 152 and slots 153, 154 provide means for adjusting the tilt of device 90 with respect to tube 14. It will be noticed, for example, that in FIG. 1 device 90 is shown tilted slightly outwardly whereas device 85 is illustrated as assuming a position more nearly that of true vertical. Appropriately-sized pins 160–163 are employed to locate and assist in holding plates 130, 131 in proper relative relation. Also, since it is desirable to be able to accommodate to different size packages and thus different sizes of tube 14, pins 160–163 are readily removable and replaceable by shorter or longer pins in conjunction with adding or reducing the number of magnets 140–143 and reducing or increasing the width of the belt 106. In this same regard, the belt-mounting arrangement illustrated in FIG. 6 incorporates easily removed and replaceable pulley hubs 117, 118 to facilitate expanding or reducing the width of device 90 as required to accommodate to different sizes of tube 14.

Belt 106 travels over a plurality of parallel and vertically spaced rollers 170 mounted for rotation on a support plate 175 supported by bolts 176, 177. In and out positioning of bolts 176, 177 to effect in and out position of rollers 170 is achieved by means of eye bolt supports 180, 181 mounted in brackets 182, 183 and adjusted by means of nuts 184, 185. Positioning of rollers 170 is used to achieve a desirable air space 190 between bar 115 and plates 130, 131 so as to prevent bar 115 becoming magnetically adhered to plates 130, 131.

Since the construction of device 80 follows the construction previously described with reference to device 90, no further detailed description with regard to device 85 will be given. The description will, therefore, next turn to describing how the apparatus and method of the invention operate in themselves and also in conjunction with the described prior art apparatus.

Figure 8:
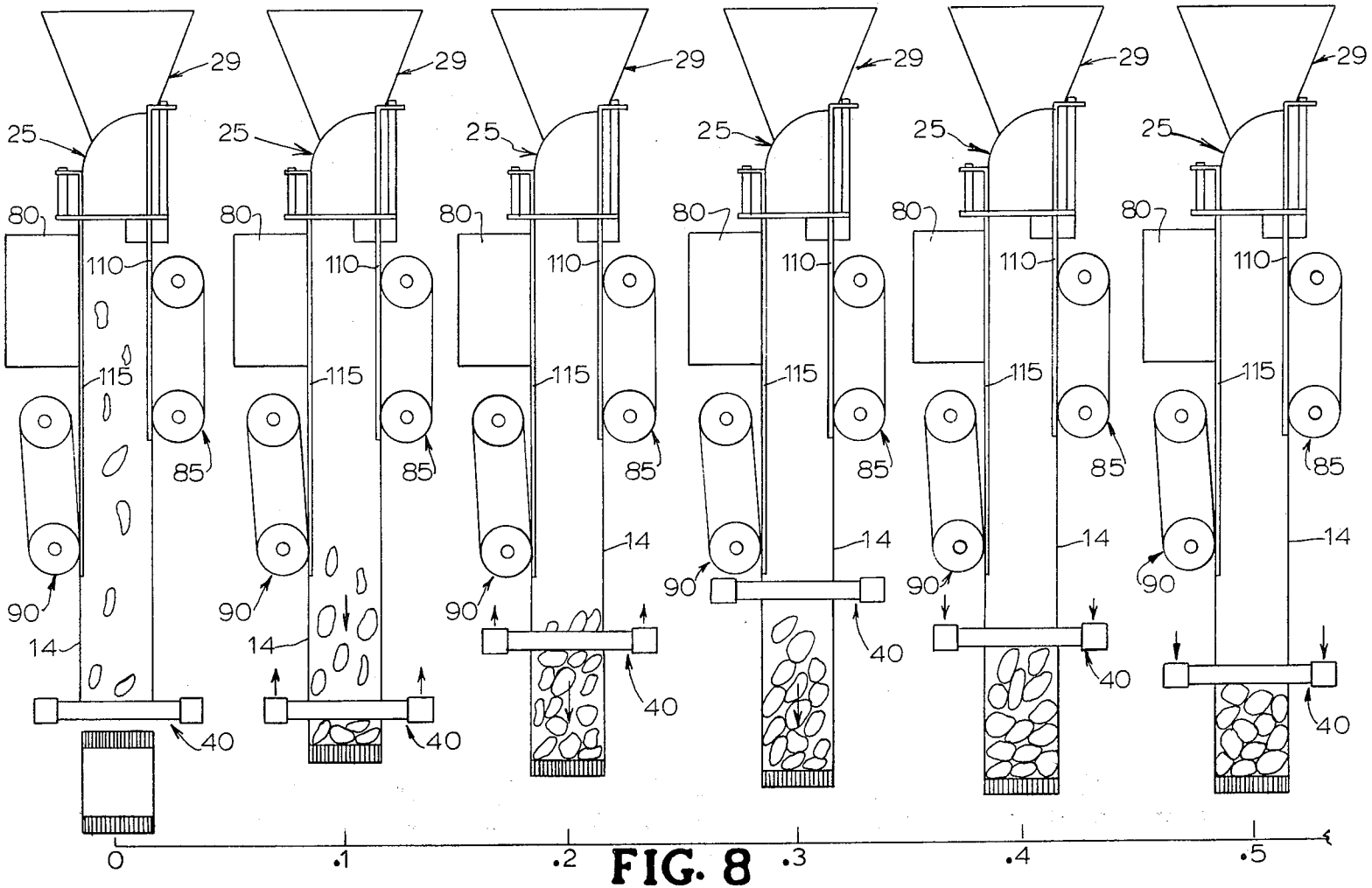
FIG. 8 represents a schematic illustration of the time sequence of operation of the invention apparatus.
Figure 9:
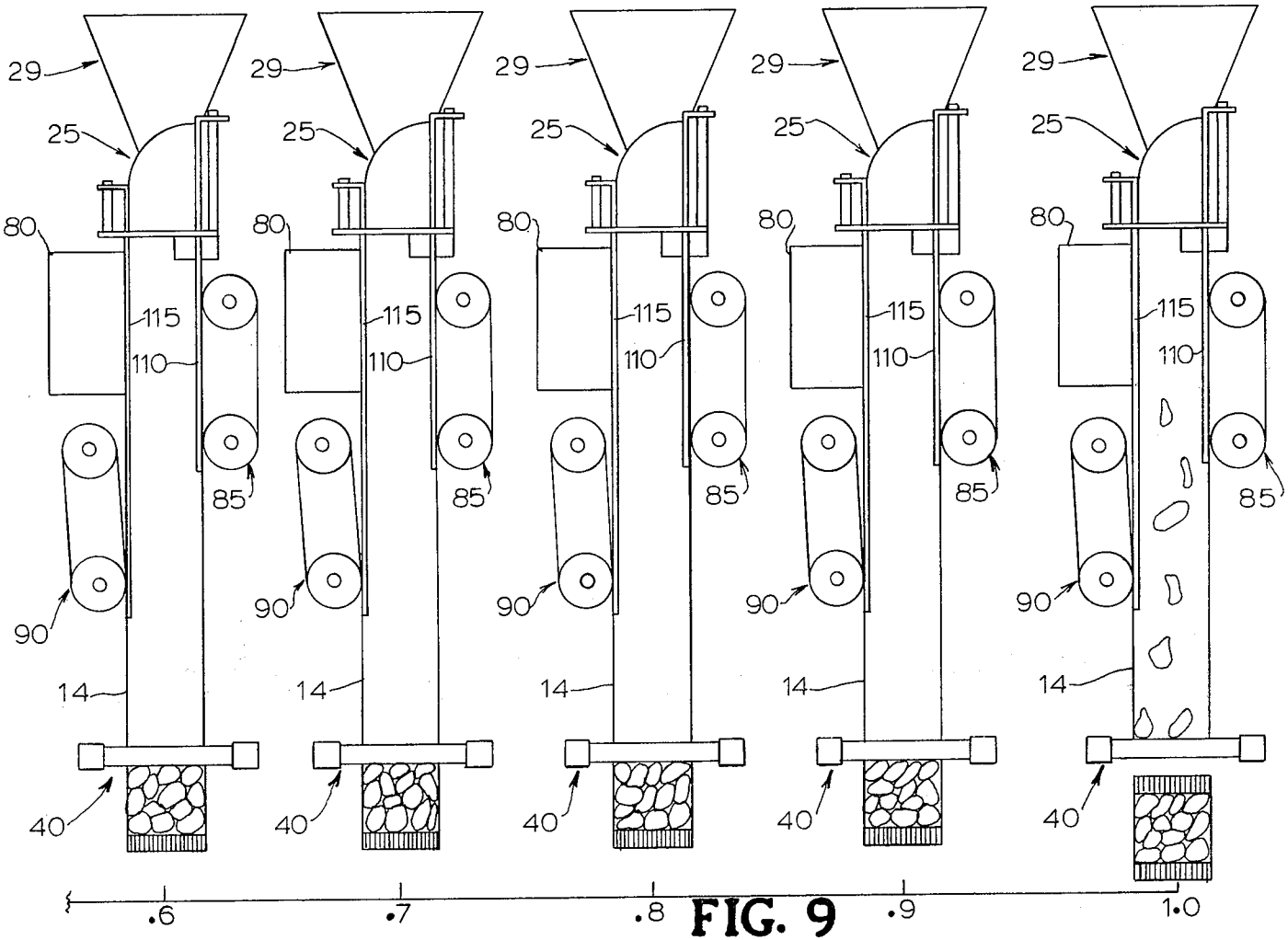
FIG. 9 is a continuation of the time sequence shown in FIG. 8.

With particular reference to FIGS. 8 and 9, there is shown by ways of example a one minute timed sequence broken down by tenths of a minute and which might be typical, for example, in a potato chip packaging operation for which the invention apparatus and method are particularly suited.

The respective magnetic sources in devices 85, 90 of the invention may be either permanent magnet sources, as illustrated, or in the form of electromagnets. Such electromagnetic sources may be continually energized and thereby always magnetically attracting the respective bars 110, 115. Alternatively, such electromagnetic sources may be energized intermittently such as at time when fill material is being poured and opening of tube 14 is critical or when tube 14 is being advanced and gripping of the tube material by devices 85, 90 is necessary. In conjunction with the magnet operation the belts on devices 85, 90 can be driven continuously, only when the electromagnetic sources are energized or only during portions of the times when the electromagnetic sources are operative dependent on the desired tube opening or tube advancing function required at the particular times. When sealer 80 is also of the magnetic bar type according to U.S. Pat. No. 2,982,334, the electromagnetic source therein may be continuously energized by the sealing function and also at the same time achieve a tube opening function. Bars 110, 115 are flexible as in U.S. Pat. No. 2,982,334.

To illustrate a typical sequence of operation and with reference to FIGS. 1, 8 and 9, it will be assumed that devices 85, 90 use permanent magnet sources and thereby constantly attract bars 110, 115. In this mode of operation, bars 110, 115 will only have one position, namely a position in which the respective bars are being magnetically attracted towards the respective devices 85, 90. It will be further assumed that the cycle starts when one package has just been severed from tube 14 and the next package is beginning to be filled, this being time zero. With these assumptions in mind and with continued reference to FIGS. 1, 8 and 9, the following table llustrates a representative sequence of operation with respect to those components of the apparatus most closely associated with the invention:

| | | | Operating Sequence | | |
|---|---|---|---|---|---|
| Time | Tube | Hopper Filling Source | Web Feed Roller 28 | Belts 101, 106 on Devices 89,90 | Stripping, Draw Down, Sealing Mechanism 40 |
| 0 | Stopped | Flowing | Stopped | Stopped | Stopped vertically Jaws moving apart Severed package drops |
| .1 | Moving Down | Closed | Rotating | Moving | Moving up vertically Jaws apart |
| .2 | Moving Down | Closed | Rotating | Moving | Moving up vertically Jaws apart |
| .3 | Moving Down | Closed | Rotating | Moving | Stopped vertically Jaws move in partially |
| .5 | Stopped | Closed | Stopped | Stopped | Moving down vertically Jaws stripping |
| .6 | Stopped | Closed | Stopped | Stopped | Stopped vertically Jaws close to seal |
| .7 | Stopped | Closed | Stopped | Stopped | Stopped vertically Jaws sealing |
| .8 | Stopped | Closed | Stopped | Stopped | Stopped vertically Jaws sever seal |
| .9 | Stopped | Closed | Stopped | Stopped | Stopped vertically Jaws move apart |
| 1.0 | | | cycle starts repeating | | |

Figure 5:
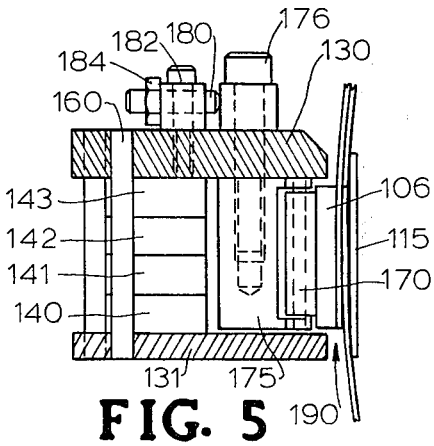
FIG. 5 is a sectional view taken generally in the direction of line 5—5 of FIG. 3.
Figure 7:
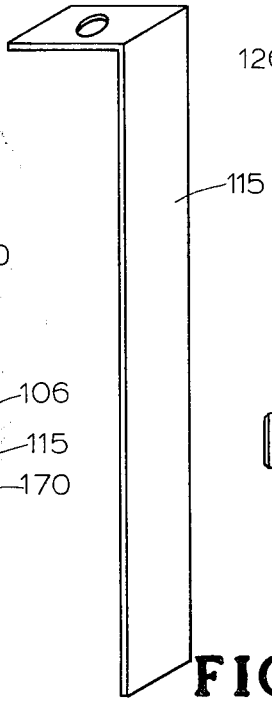
FIG. 7 is a perspective view of one of the magnetizable bars employed with the invention apparatus.
Figure 6:
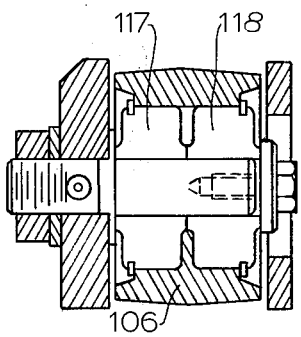
FIG. 6 is a sectional view taken generally in the direction of line 6—6 of FIG. 4 illustrating an idler pulley.

Certain significant differences both in construction and operation should be recognized in comparing the magnetic bar device of U.S. Pat. No. 2,982,334 with the magnetic bar devices 85, 90 of the present invention. The present invention recognizes, for example, that the magnetic bar device of the patent was primarily intended for sealing. Thus, in the patent device it was desirable that essentially no or at least a minimal air gap be maintained between the magnetic bar and the magnetic source when operative. Such mode of operation in which the magnetic bar of the patent device was effectively magnetically adhered to the magnetic source during sealing was desirable for the sealing function. In contrast, in the magnetic bar devices 85, 90 of the present invention, a precisely controlled, substantially uniform air gap, i.e., gap 190, is purposely maintained between the respective magnet bars and the respective magnetic sources so that the tube material can be effectively clamped between the respective belts of the invention devices 85, 90 and the respective magnet bars to effect the desired tube opening and tube advancing functions but without having the magnetic source structure actually engage the surface of the tube material as best illustrated in FIG. 5. Further, by utilizing the typical nonmagnetic properties of belt 106 and making rollers 170, plate 175, bolts 176, 177 and bolts 180, 181 all of nonmagnetic material while making plates 130, 131 of magnetic material, a substantially strong magnetic pull can be achieved on the respective magnet bars 110, 115. Further, by coating the respective bars 110, 115 with a suitable friction-reducing material, e.g., "Teflon" material, the respective belts of the invention devices 85, 90 are able to advance the tube material with a positive gripping action and with ease of operation. Also to be noted is that by making the magnet bars 110, 115 of relatively thin magnetic strip material, the magnetic bars exhibit a desired degree of flexibility particularly when not being magnetically clamped so as to further enhance flow of fill material particularly of the character of potato chips where a somewhat flexible tube path is highly desirable in view of the constantly changing nature of the fill material.

Another desirable characteristic of the present invention is that while the invention devices 85, 90 are illustrated in FIG. 2 as being positioned on what are commonly referred to as the respective front and back sides of tube 14 at the respective positions P-1, P-3, the invention recognizes other possible orientations of the invention devices. For example, device 85 could be positioned at position P-2 and device 90 could be positioned at position P-4 as indicated in FIG. 2 with device 80 remaining in position P-3. Those skilled in the art will readily appreciate that the desired tube opening and material clamping functions for purposes of tube advancement can be achieved with the invention devices in any of the indicated orientations as best illustrated in FIG. 2.

While it is anticipated that the magnetic bar devices 85, 90 of the invention will normally find application in a package forming and filling machine in which the tube is formed around a vertical axis, it will be appreciated that any time the invention devices 85, 90 have their respective magnetic sources operative, the respective magnet bars 110, 115 will be drawn outwardly from the central axis of the tube. Thus, the invention devices 85, 90 lend themselves to applications in which the packaging material is formed into a tube which travels in other than a strictly vertical direction and in which the filling operation could be assisted by force feed mechanisms so as not to be totally dependent on gravity feed as in the illustrated embodiment.

The desirability of maintaining a flow path which has a high degree of flexibility for handling fill materials of constantly changing character is also enhanced by the fact that the tube material which is not magnetically clamped, e.g., between and on both sides of positions P-1 and P-3 as in FIG. 2 is free to flex. Thus, the majority of the packaging tube form remains flexible during filling. In contrast, the prior art practice of using a rigid metal tube within the formed tube of packaging material essentially rigidifies the tube form of packaging material and prevents flexibility which has proven not be desirable when handling material of the character of potato chips.

We claim:

1. In a package forming and filling machine, in combination:

(a) a frame structure;

(b) a former for shaping packaging material into tubular form;

(c) means for sealing and severing said material into individual packages having side, top and bottom seals;

(d) means for filling each successive package after forming of the side and bottom seals thereof and before forming the top seal thereof;

(e) means for holding open the tube form making up each said successive package during the filling thereof comprising:

(i) a pair of oppositely positioned magnetizable bars supported on said frame structure and positioned so as to extend into said tubular form during the forming and filling of each said successive package; and (ii) a pair of magnetic field source means supported from said frame structure with one such source means being adjacent each said magnetizable bar and providing magnetic fields positioned so as to magnetically attract and draw each said bar outwardly so as to maintain said tubular form and each said successive package formed therefrom open during the filling thereof;

(f) a belt drive assembly oppositely associated with each said magnetic field source means and supported by said frame structure including for each said belt drive assembly sets of rollers over which the belt associated therewith runs when moving adjacent the respective magnetizable bar associated therewith, each said assembly having a belt engaging the outer surface of said tube form and running between the respective magnetic field source means with which such belt is associated and the respective magnetizable bar attracted thereto;

(g) means to drive each said belt at selected times coordinated with the forming, sealing and filling of packages to pull packaging material through said former; and (h) means adjustably mounting said rollers enabling the positioning of said rollers to be adjusted with respect to the position of the respective magnetic field source means associated therewith whereby to maintain a selected air gap between said respective magnetic field source means and the respective magnetizable bar associated therewith.

2. In a package forming and filling machine as claimed in claim 1 including a longitudinal sealing means having a said magnetic field source means operatively associated therewith and disposed externally of and on one side of said tube form and being appropriately positioned and adapted to also magnetically attract one of said magnetizable bars to enhance the holding open of said tube form.

3. In a package forming and filling machine as claimed in claim 1 including adjustable mounting means for each said belt drive assembly enabling the orientation of the belt associated therewith to be adjusted with respect to the respective surface of said tube form engaged thereby.

4. In a package forming and filling machine, in combination:

(a) a frame structure;

(b) a former for shaping packaging material into tubular form;

(c) means for sealing and severing said material into individual packages having side, top and bottom seals;

(d) means for filling each successive package after forming of the side and bottom seals thereof and before forming the top seal thereof; and (e) means for slidably clamping a lengthwise extending portion of the tube form making up each said successive package during the filling thereof comprising:

(i) a magnetizable bar supported on said frame structure and positioned so as to extend into said tubular form opposing the said tube portion to be clamped during the forming and filling of each said successive package;

(ii) magnetic field source means;

(iii) means supported by said frame structure for supporting said magnetic field source means adjacent said magnetizable bar enabling said magnetic field source means to provide a magnetic field positioned so as to magnetically attract and draw said bar outwardly to clamp the said tube portion of said tubular form of each said successive package formed therefrom; and (iv) means for maintaining a substantially uniform air gap between said bar and the outermost extremities of said magnetic field source means closest said bar and adapted to prevent said bar from magnetically adhering to said magnetic field source means and to provide a surface adapted for slidably supporting the external surface of said portion of said tube form.

5. In a package forming and filling machine as claimed in claim 4 including means for advancing said tubular form coordinated with the forming, filling and sealing of said packages.

6. In a package forming and filling machine as claimed in claim 5 wherein said means for advancing said tubular form comprises a belt drive assembly associated with said magnetic field source means and supported by said frame structure, said assembly having a belt engaging the outer surface of said portion of said tube form and running between said magnetic field source means and said bar and including means to drive said belt at selected times coordinated with the forming, sealing and filling of said packages to pull packaging material through said former.

7. In a package forming and filling machine, in combination:

(a) a frame structure;

(b) a former for shaping packaging material into tubular form;

(c) means for sealing and severing said material into individual packages having side, top and bottom seals;

(d) means for filling each successive package after forming the side and bottom seals thereof and before forming the top seal thereof;

(e) means for holding open the tubular form making up each said successive package during the filling thereof comprising:

(i) a pair of magnetizable bars supported on said frame structure and positioned so as to extend into said tubular form at selected peripheral positions during the forming and filling of each said successive package; and (ii) a pair of magnetic field source means supported from said frame structure with one such source means being adjacent each said magnetizable bar and providing magnetic fields positioned so as to magnetically attract and draw each said bar outwardly so as to maintain said tubular form open at the respective positions of said bars; and (f) means associated with each said magnetic field source means for holding each respective said bar in spaced relation from the respective magnetic field source means to which it is attracted to maintain an air space therebetween.

8. In a package forming and filling machine as claimed in claim 7 including driven means for advancing said tubular form in coordination with the forming, filling, sealing and severing of said packages.

9. In a package forming and filling machine as claimed in claim 7 wherein said means for holding each said bar in spaced relation is adjustable enabling the width of said air space to be adjusted.

10. In a a package forming and filling machine as claimed in claim 7 wherein said means for holding each said bar in spaced relation comprises a series of rollers adapted to engage the outer surface of said tubular form opposite each said respective bar when magnetically attracted to the respective said magnetic field source means.

11. The method in a package forming and filling machine for holding the formed, longitudinal and bottom sealed tube form open during filling, comprising:

(a) supporting a pair of magnetizable bars within the tube form;

(b) magnetically attracting such bars outwardly during filling with opposing magnetic field source means for each said bar to maintain the tube form open; and (c) maintaining a substantially uniform air gap between each said bar and the opposing said magnetic field source means.

12. The method of claim 11 including the additional step of advancing the tube form while being held open by said magnetizable bars by engaging outer surfaces of said tube form opposing said bars with belts and driving said belts to effect the advancing of said tube.

13. In a package forming and filling machine, in combination:

(a) a frame structure;

(b) a former for shaping packaging material into tubular form;

(c) means for sealing and severing said material into individual packages having side, top and bottom seals;

(d) means for filling each successive package after forming of the side and bottom seals thereof and before forming the top seal thereof;

(e) means for holding open the tube form making up each said successive package during the filling thereof comprising:

(i) a pair of oppositely positioned magnetizable bars supported on said frame structure and positioned so as to extennd into said tubular form during the forming and filling of each said successive package; and (ii) a pair of magnetic field source means supported from said frame structure with one such source means being adjacent each said magnetizable bar and providing magnetic fields positioned so as to magnetically attract and draw each said bar outwardly so as to maintain said tubular form and each said successive package formed therefrom open during the filling thereof; and (f) means associated with each said magnetic field source means for holding each respective said bar in spaced relation from the respective magnetic field source means to which it is attracted to maintain an air space therebetween.

14. In a package forming and filling machine, in combination:

(a) a frame structure;

(b) a former for shaping packaging material into tubular form;

(c) means for sealing and severing said material into individual packages having side, top and bottom seals;

(d) means for filling each successive package after forming of the side and bottom seals thereof and before forming the top seal thereof;

(e) means for holding open the tube form making up each said successive package during the filling thereof comprising:

(i) a pair of oppositely positioned magnetizable bars supported on said frame structure and positioned so as to extend into said tubular form during the forming and filling of each said successive package; and (ii) a pair of magnetic field source means supported from said frame structure with one such source means being adjacent each said magnetizable bar and providing magnetic fields positioned so as to magnetically attract and draw each said bar outwardly so as to maintain said tubular form and each said successive package formed therefrom open during the filling thereof; and (f) means for maintaining a substantially uniform air gap between each said bar and the outermost extremities of said magnetic field source means closest said bar to which it is attracted and adapted to prevent each said bar from magnetically adhering to the said magnetic field source means to which it is attracted and to provide a surface adapted for slidably supporting the external surface of said tube form.

15. In a package forming and filling machine, in combination:

(a) a frame structure;

(b) a former for shaping packaging material into tubular form;

(c) means for sealing and severing said material into individual packages having side, top and bottom seals;

(d) means for filling each successive package after forming the side and bottom seals thereof and before forming the top seal thereof;

(e) means for holding open the tubular form making up each said successive package during the filling thereof comprising:

(i) a pair of magnetizable bars supported on said frame structure and positioned so as to extend into said tubular form at selected peripheral positions during the forming and filling of each said successive package; and (ii) a pair of magnetic field source means supported from said frame structure with one such source means being adjacent each said magnetizable bar and providing magnetic fields positioned so as to magnetically attract and draw each said bar outwardly so as to maintain said tubular form open at the respective positions of said bars; and (f) means for maintaining a substantially uniform air gap between each said bar and the outermost extremities of said magnetic field source means closest said bar to which it is attracted and adapted to prevent each said bar from magnetically adhering to the said magnetic field source means to which it is attracted and to provide a surface adapted for slidably supporting the external surface of said tube form.

* * * * *